US006138840A

United States Patent [19]

Seip

[11] Patent Number: 6,138,840

[45] Date of Patent: Oct. 31, 2000

[54] STORAGE CLOSET AND RACK APPARATUS

[76] Inventor: Duncan B. Seip, 30 5th St., Frenchtown, N.J. 08825

[21] Appl. No.: 09/512,444

[22] Filed: Feb. 25, 2000

[51] Int. Cl.[7] ..... A45F 7/00

[52] U.S. Cl. ..... 211/70.8; 312/902; 220/315.11

[58] Field of Search ..... 312/245, 902; 211/70.8; 43/54.1, 26; 206/315.11

[56] References Cited

U.S. PATENT DOCUMENTS

| | | | |
|---|---|---|---|
| 2,097,185 | 10/1937 | Hall | 43/26 |
| 2,555,073 | 5/1951 | Zdankoski | 211/70.8 |
| 2,641,520 | 6/1953 | Moore | 312/902 |
| 2,797,137 | 6/1957 | Ford | 312/902 |
| 2,816,390 | 12/1957 | Vaughn et al. | 43/26 |
| 3,641,697 | 2/1972 | Heidtman et al. | 206/315.11 |
| 4,003,612 | 1/1977 | Munsell | 211/70.8 |
| 4,353,182 | 10/1982 | Junkas et al. | 206/315.11 |
| 4,378,882 | 4/1983 | Miller | 206/315.11 |

*Primary Examiner*—Peter M. Cuomo
*Assistant Examiner*—Jerry A. Anderson

[57] ABSTRACT

A storage closet and rack apparatus for holding and storing fishing accessories. The storage closet and rack apparatus includes a housing. The housing has a back wall, a first side wall, a second side wall, a bottom wall, a top wall and a front side. The front side comprises a plurality of panels. The plurality of panels includes drawers, doors and a desk. The housing has a plurality of compartments therein. A portion of the compartments has fishing reel mountings therein. Each of the fishing reel mountings is coupled to a wall of the compartments. Each of the fishing reel mountings is adapted for holding a fishing reel. A pair of securing means releasably secures fishing poles to the housing. Each of the securing means is fixedly coupled to both of the first and second side walls of the housing.

11 Claims, 6 Drawing Sheets

STORAGE CLOSET AND RACK APPARATUS

BACKGROUND OF THE INVENTION

1. Field of the Invention

The present invention relates to storage closets and more particularly pertains to a new storage closet and rack apparatus for holding and storing fishing accessories.

2. Description of the Prior Art

The use of storage closets is known in the prior art. More specifically, storage closets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,986,427; U.S. Pat. No. 5,054,228; U.S. Pat. No. 5,487,475; U.S. Pat. No. 5,704,158; U.S. Pat. No. 5,347,746; and Des. Pat. No. 391,785.

While these devices fulfill their respective, particular objectives and requirements, the aforementioned patents do not disclose a new storage closet and rack apparatus. The inventive device includes a housing. The housing has a back wall, a first side wall, a second side wall, a bottom wall, a top wall and a front side. The front side comprises a plurality of panels. The plurality of panels includes drawers, doors and a desk. The housing has a plurality of compartments therein. A portion of the compartments has fishing reel mountings therein. Each of the fishing reel mountings is coupled to a wall of the compartments. Each of the fishing reel mountings is adapted for holding a fishing reel. A pair of securing means releasably secures fishing poles to the housing. Each of the securing means is fixedly coupled to both of the first and second side walls of the housing.

In these respects, the storage closet and rack apparatus according to the present invention substantially departs from the conventional concepts and designs of the prior art, and in so doing provides an apparatus primarily developed for the purpose of holding and storing fishing accessories.

SUMMARY OF THE INVENTION

In view of the foregoing disadvantages inherent in the known types of storage closets now present in the prior art, the present invention provides a new storage closet and rack apparatus construction wherein the same can be utilized for holding and storing fishing accessories.

The general purpose of the present invention, which will be described subsequently in greater detail, is to provide a new storage closet and rack apparatus apparatus and method which has many of the advantages of the storage closets mentioned heretofore and many novel features that result in a new storage closet and rack apparatus which is not anticipated, rendered obvious, suggested, or even implied by any of the prior art storage closets, either alone or in any combination thereof.

To attain this, the present invention generally comprises a housing. The housing has a back wall, a first side wall, a second side wall, a bottom wall, a top wall and a front side. The front side comprises a plurality of panels. The plurality of panels includes drawers, doors and a desk. The housing has a plurality of compartments therein. A portion of the compartments has fishing reel mountings therein. Each of the fishing reel mountings is coupled to a wall of the compartments. Each of the fishing reel mountings is adapted for holding a fishing reel. A pair of securing means releasably secures fishing poles to the housing. Each of the securing means is fixedly coupled to both of the first and second side walls of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage closet and rack apparatus apparatus and method which has many of the advantages of the storage closets mentioned heretofore and many novel features that result in a new storage closet and rack apparatus which is not anticipated, rendered obvious, suggested, or even implied by any of the prior art storage closets, either alone or in any combination thereof.

It is another object of the present invention to provide a new storage closet and rack apparatus which may be easily and efficiently manufactured and marketed.

It is a further object of the present invention to provide a new storage closet and rack apparatus which is of a durable and reliable construction.

An even further object of the present invention is to provide a new storage closet and rack apparatus which is susceptible of a low cost of manufacture with regard to both materials and labor, and which accordingly is then susceptible of low prices of sale to the consuming public, thereby making such storage closet and rack apparatus economically available to the buying public.

Still yet another object of the present invention is to provide a new storage closet and rack apparatus which provides in the apparatuses and methods of the prior art some of the advantages thereof, while simultaneously overcoming some of the disadvantages normally associated therewith.

Still another object of the present invention is to provide a new storage closet and rack apparatus for holding and storing fishing accessories.

Yet another object of the present invention is to provide a new storage closet and rack apparatus which includes a housing. The housing has a back wall, a first side wall, a second side wall, a bottom wall, a top wall and a front side. The front side comprises a plurality of panels. The plurality of panels includes drawers, doors and a desk. The housing has plurality of compartments therein. A portion of the compartments has fishing reel mountings therein. Each of the fishing reel mountings is coupled to a wall of the compartments. Each of the fishing reel mountings is adapted for holding a fishing reel. A pair of securing means releasably secures fishing poles to the housing. Each of the securing means is fixedly coupled to both of the first and second side walls of the housing.

Still yet another object of the present invention is to provide a new storage closet and rack appratus that includes a desk for a work station.

Even still another object of the present invention is to provide a new storage closet and rack apparatus that contains fishing reel holders or safety and efficiently holding a plurality of fishing reels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
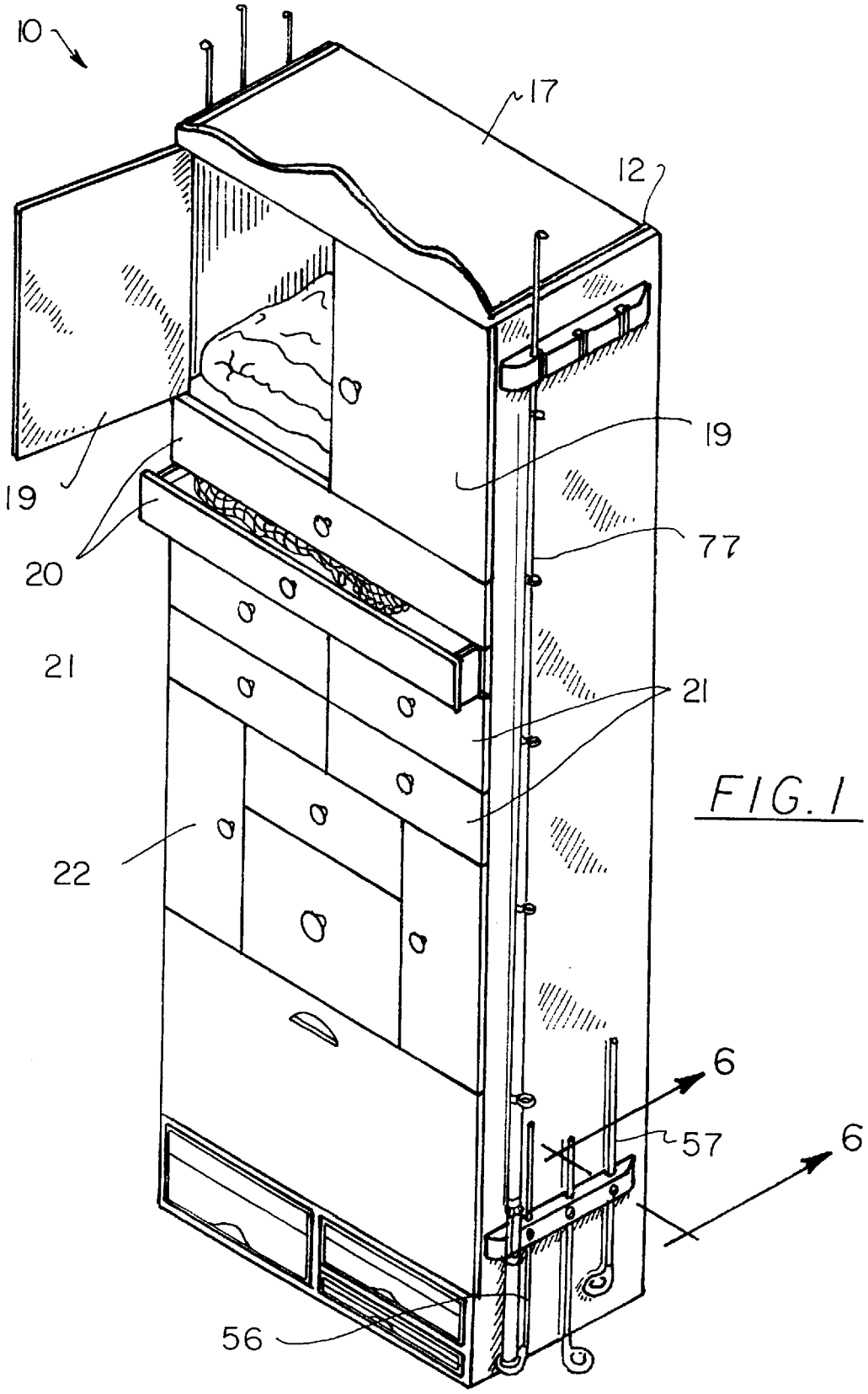
FIG. 1 is a schematic perspective view of a new storage closet and rack apparatus according to the present invention.
Figure 2:
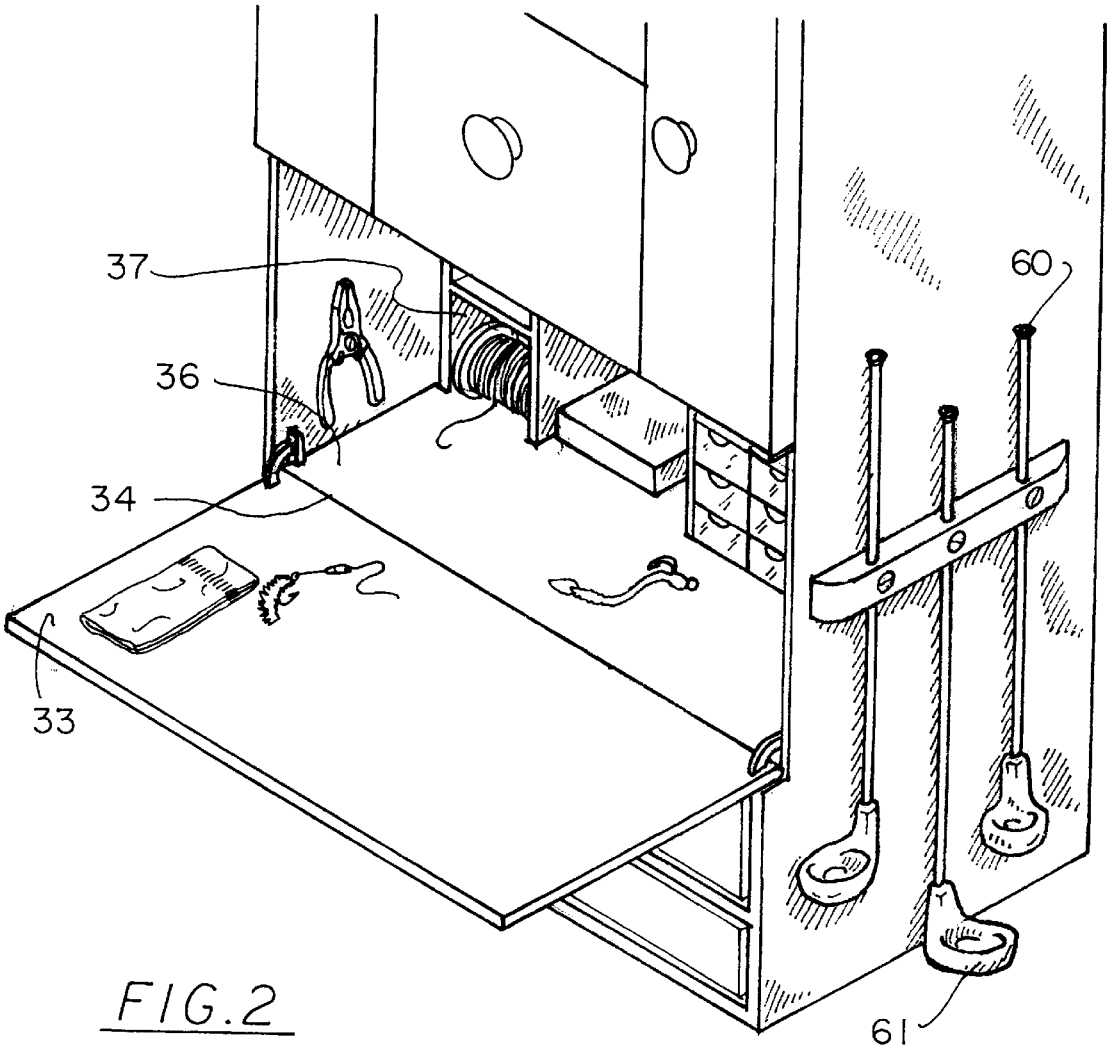
FIG. 2 is a schematic perspective view of the present invention.
Figure 3:
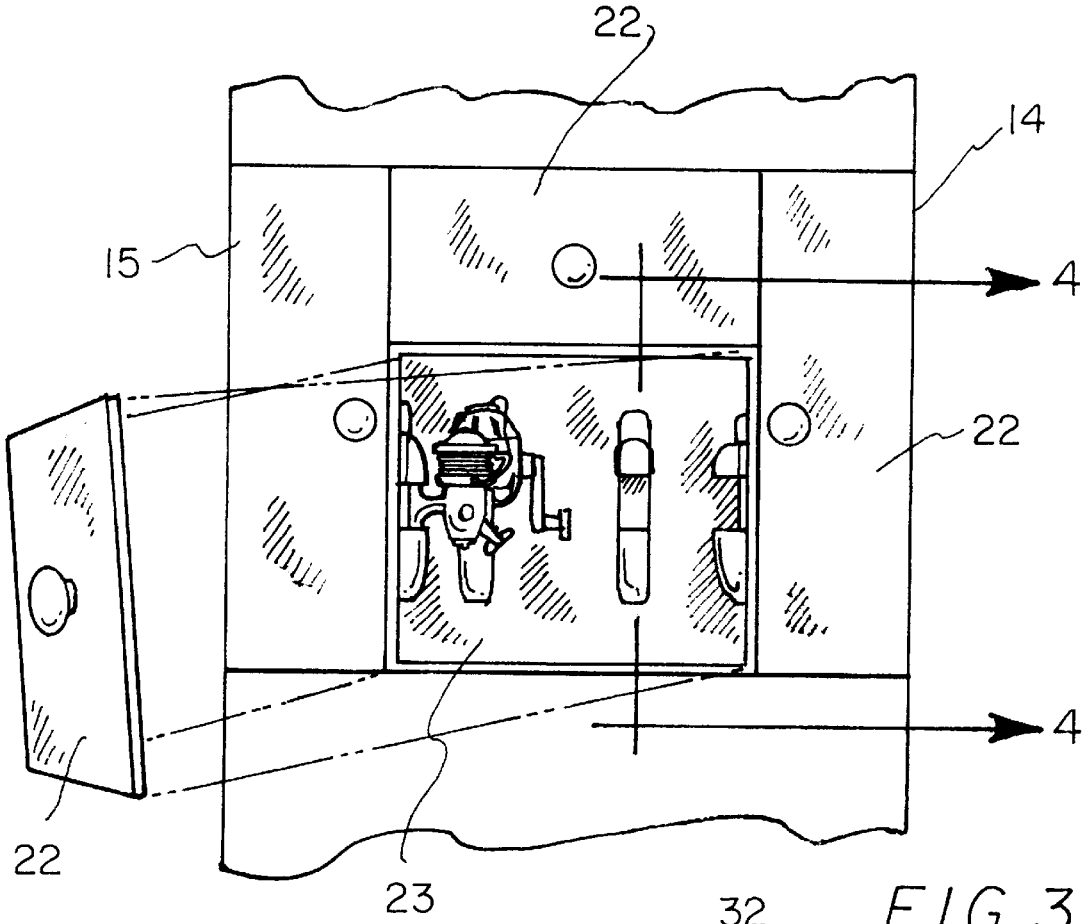
FIG. 3 is a schematic front view of the present invention.
Figure 4:
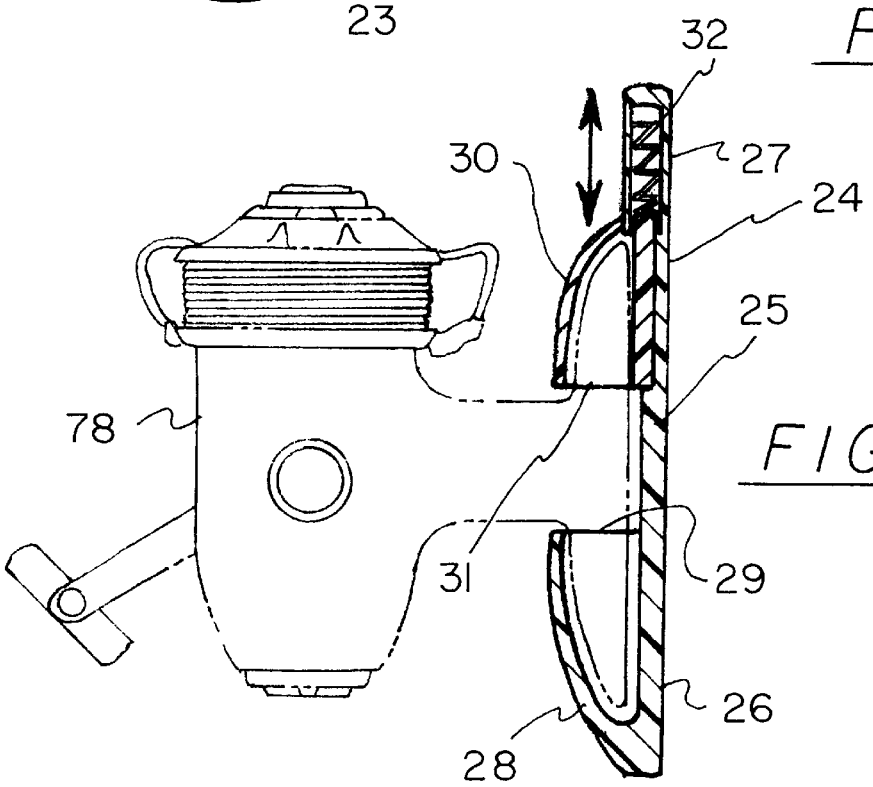
FIG. 4 is a schematic cross-sectional view taken along line 4—4 of the present invention.
Figure 5:
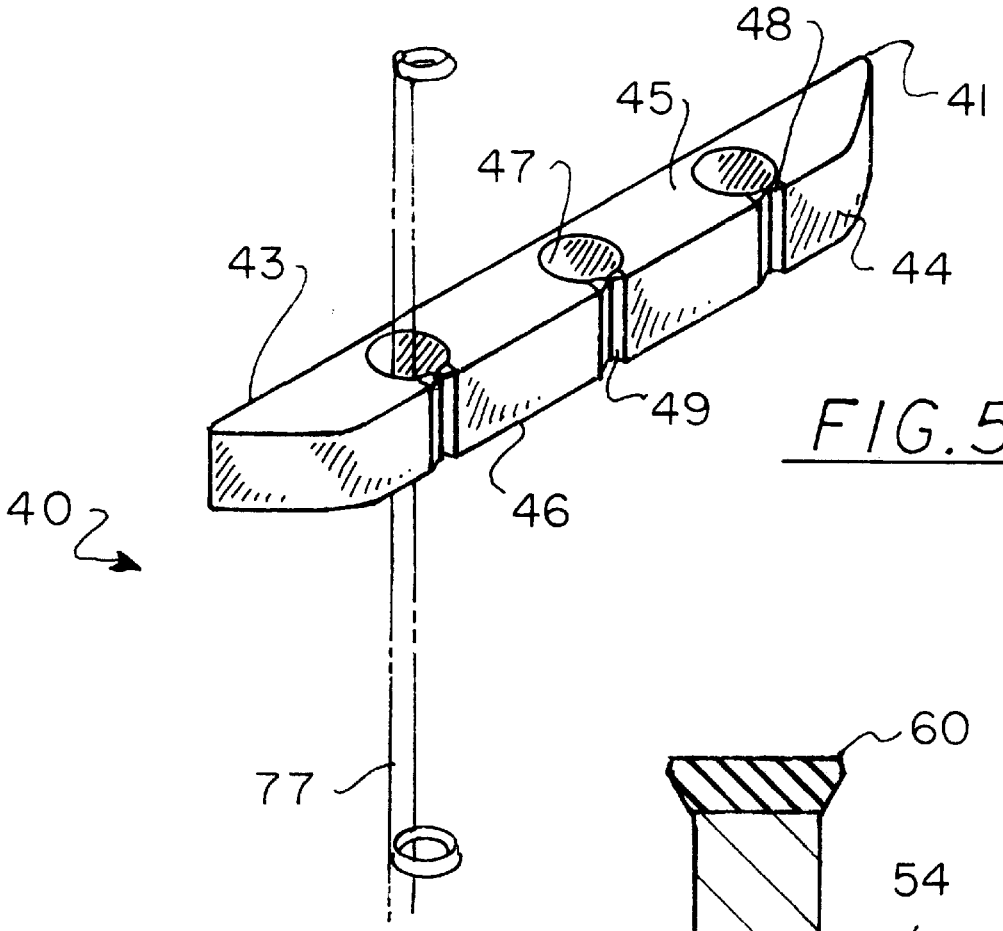
FIG. 5 is a schematic perspective view of the top bracket of the securing means of the present invention.
Figure 6:
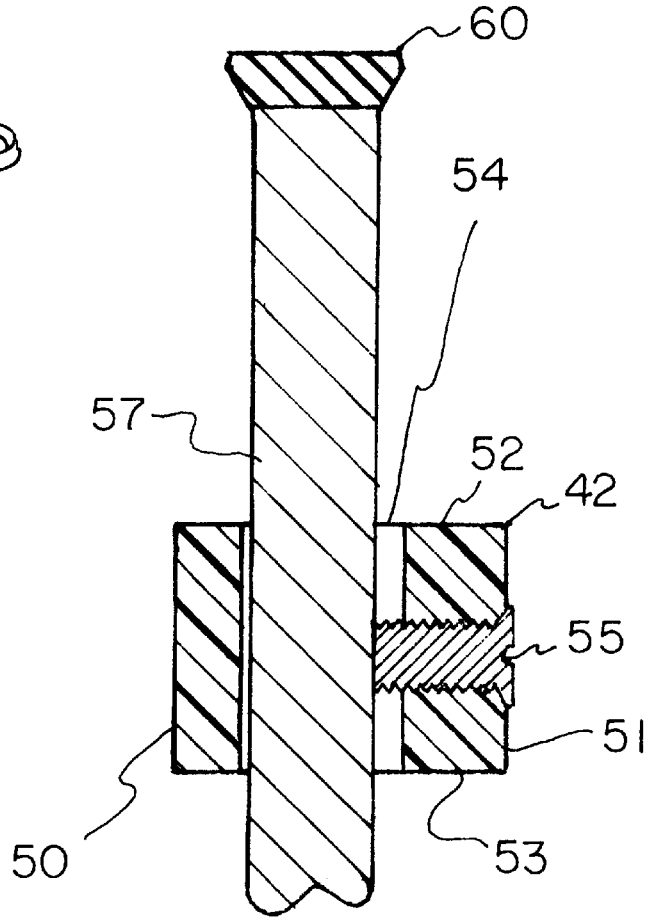
FIG. 6 is a schematic perspective view of the lower bracket of the securing means of the present invention.
Figure 7:
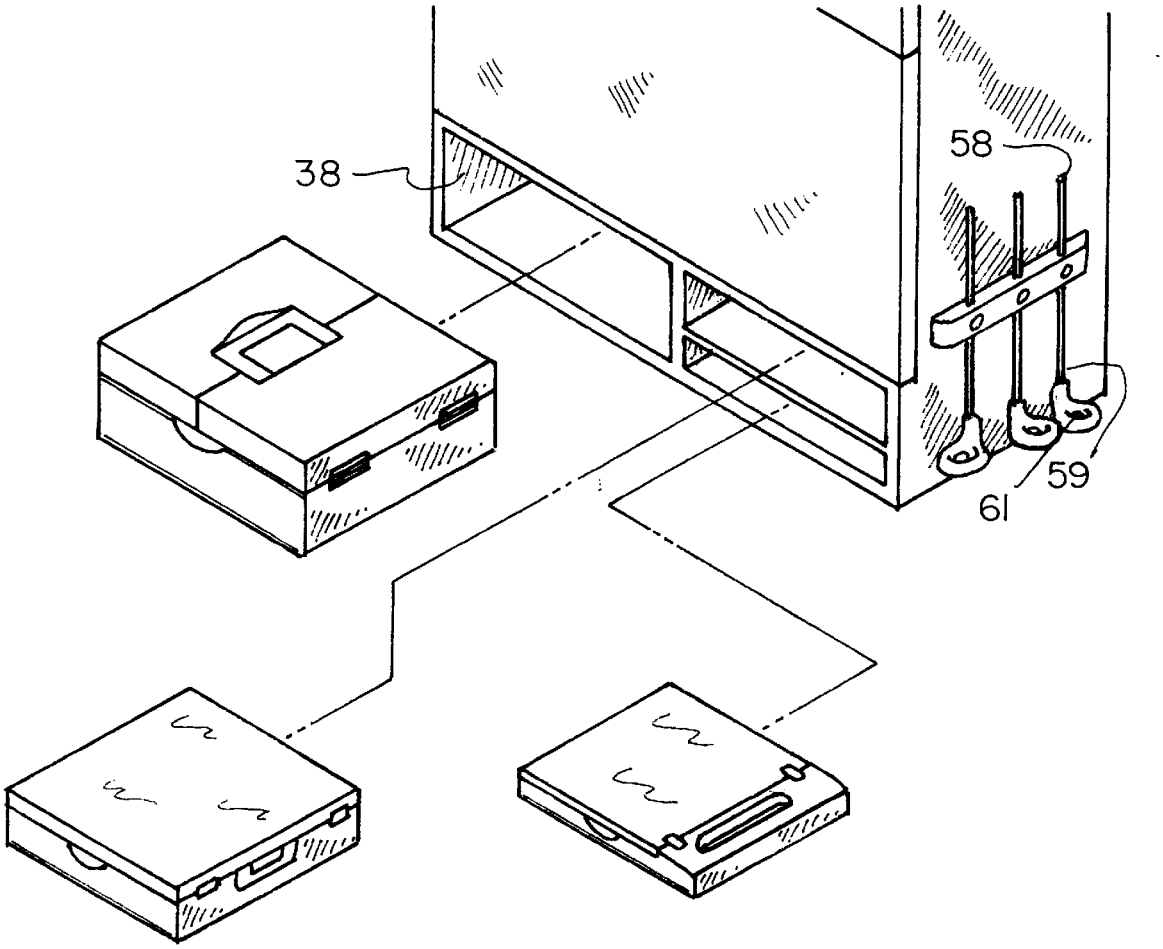
FIG. 7 is a schemiatic perspective view of the cubbyholes of the present invention.
Figure 8:
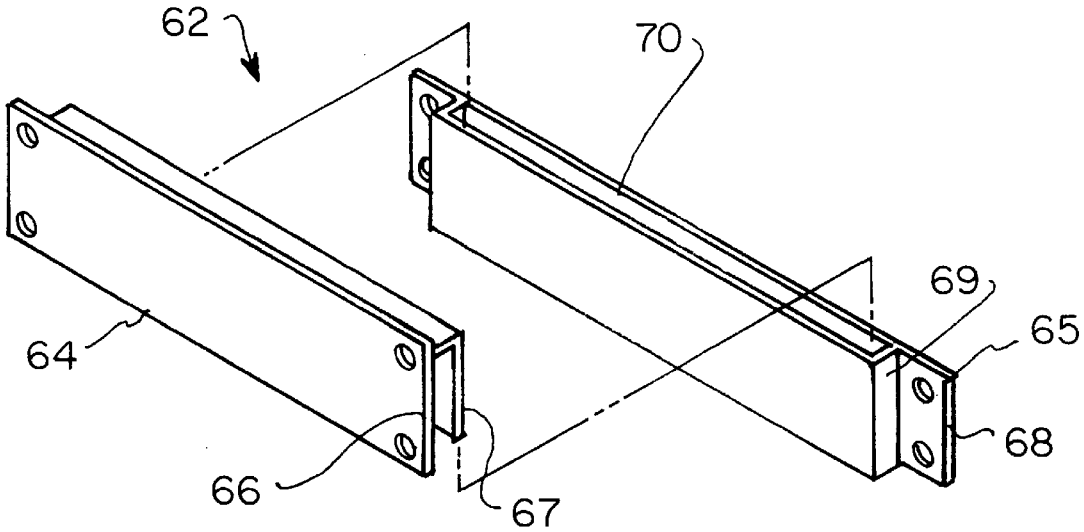
FIG. 8 is a schematic perspective view of the fastening means of the present invention.

With reference now to the drawings, and in particular to FIGS. 1 through 9 thereof, a new storage closet and rack apparatus embodying the principles and concepts of the present invention and generally designated by the reference numeral 10 will be described.

As best illustrated in FIGS. 1 through 9, the storage closet and rack apparatus 10 generally comprises a housing 12. The housing 12 has a back wall 13, a first side wall 14, a second side wall 15, a bottom wall 16, a top wall 17 and a front side 18. The front side 18 includes a plurality of panels. The plurality of panels comprises drawers, doors and a desk.

The plurality of panels includes a first set of panels 19 comprising a pair of doors. The first set of panels 19 is generally adjacent to the top wall 17. Each of the panels of the first set of panels 19 are hingedly coupled to the first 14 and second 15 side walls. A shelf is mounted in the housing. The shelf is generally adjacent to each the bottom edges of the first set of panels.

A second set of panels 20 comprises drawers. The second set of panels 20 is generally adjacent to the first set of panels 19. Each of the panels of the second set of panels 20 are slidably mounted in the housing 12. The second set of panels 20 is positioned generally in a two by one matrix.

A third set of panels 21 also comprises drawers. The third set of panels 21 is located generally adjacent to the second set of panels 20. Each of the panels of third set of panels 21 is slidably mounted in the housing. The third set of panels 21 is positioned generally in a two by two matrix.

A fourth set of panels 22 is located generally adjacent to the third set of panels 21. The fourth set of panels 21 comprises removably mountable doors. Each of the panels of the fourth set of panels 22 is removably mountable to a compartment 23 in the housing such that there are four compartments. Each of the compartments has fishing reel mounting is 24 therein. Each of the fishing reel mountings 24 is fixedly coupled to a wall in the compartments 23.

Each of the fishing reel mountings 24 includes a base portion 25. The base portion 25 is elongate and has a distal portion 26 and a proximal portion 27. A first sleeve 28 is integrally mounted to the distal portion 26 of the base portion 25. The first sleeve 28 is generally hollow and has an opening 29 directed toward the proximal portion 27 of the base portion 25. A second sleeve 30 is slidably mounted in the proximal portion 27. The second sleeve 30 is generally hollow and has an opening 31 directed toward the distal portion 26. A biasing means 32 biases the second sleeve 30 toward the first sleeve 28. The biasing means 32 is mounted in the proximal portion 27 of the base portion 25. The biasing means 32 is a spring.

Figure 9:
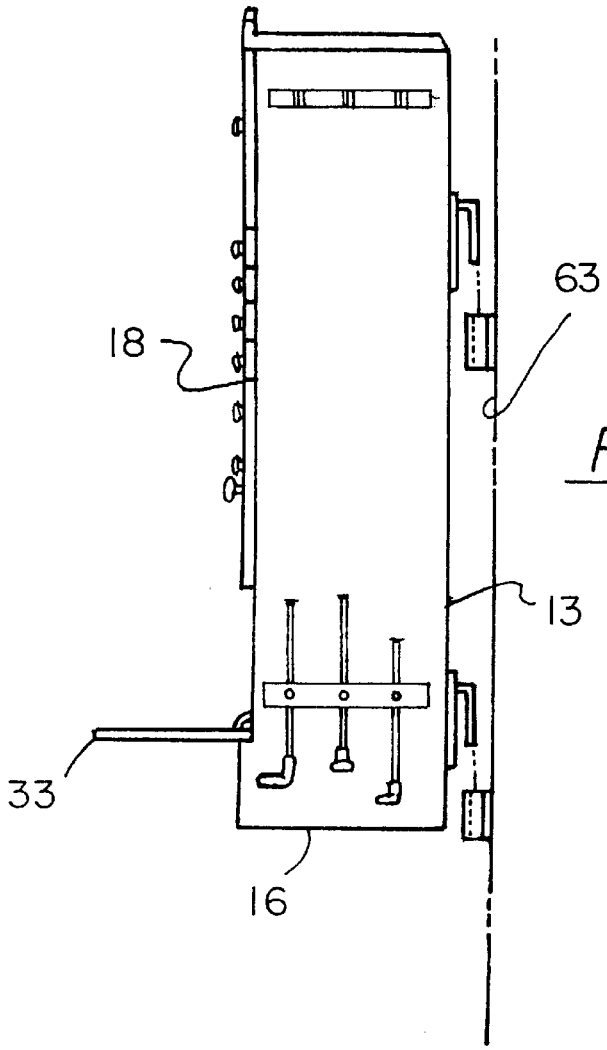
FIG. 9 is a schematic side view of the present invention.

A fifth panel 33 is generally adjacent to the fourth set of panels 22. The fifth panel 33 has a bottom edge 34 hingedly coupled to the first 14 and second 15 side walls by a pair of hinges 35. Each of the hinges 35 has a stop therein such that the fifth panel 33 is biased against moving below a horizontal position as shown in FIG. 9. The fifth panel 33 defines a desk. A shelf 36 is mounted in the housing 12. The shelf 36 is generally adjacent to the bottom edge 34 of the fifth panel 33. The shell 36 has a plurality of compartments 37 thereon.

A plurality of slots 38 extends into the front side 18 of the housing 12. Each of the slots 38 is generally located between the fifth panel 33 and the bottom wall 16 of the housing 12. The slots 38 define cubbyholes in the housing 12. The cubbyholes are used to store variously sized tackle-boxes.

A pair of securing means 40 releasably secures fishing poles 77 to the housing. Each of the securing means is fixedly coupled to one of the first 14 and second 15 side walls of the housing 12, and each of the securing means 40 includes a top bracket 41 and a bottom bracket 42.

The top bracket 41 is elongate. The top bracket 41 has a back side 43 front side 44 top side 45 and bottom side 46. The back side 43 is fixedly coupled to the housing 12. The top bracket 41 is located generally adjacent to the top wall 17 of the housing 12. The top side 45 has a plurality of bores 47 therein. The bores 47 extend through the top bracket 41. The front side 44 has a plurality of breaks 48 therein. Each of the breaks 48 is generally adjacent to one of the bores 47. The breaks 48 extend into the bores 47. Each of the breaks 48 has two sides having a nub 49 thereon. The nubs 49 preferably comprise an elastomeric material and help hold the end of a fishing rod 77 in the bores 47.

The bottom bracket 42 is elongate and has a back side 50, a front side 51, a top side 52 and bottom side 53. The back side 50 is fixedly coupled to the housing 12. The bottom bracket 42 is located generally adjacent to the fifth panel 33. The top side 52 has a plurality of bores 54 therein. The front side 51 has a plurality of screws 55 therein. Each of the screws 55 extends into the bores 54 in the bottom bracket 42.

A plurality of holders 56 is each comprised of an elongate member 57 having a first 58 and a second end 59. Each of the holders 56 is slidably mountable in the bores 54 in the bottom bracket 42. Each of the first ends 58 has an annular flange 60 thereon. The flanges 60 have a width larger than a width of the bores 54 in the bottom bracket 42 to prevent the first ends 58 of the holders 56 from sliding through the bores 54. A plurality of cups 61 holds a bottom portion of a fishing rod 77. Each of the cups 61 is fixedly coupled to one of the second ends 59 of the elongate members 57. The screws 55 are tightened against the elongate members 57 to prevent them from sliding in the bores 54 of the bottom bracket 42.

A pair of fastening means 62 removably fastens the housing 12 to a wall 63. Each of the fastening means 62 comprising a male bracket 64 and a female bracket 65. The male brackets 64 are space from each other and fixedly coupled to the back wall 13 of the housing 12. The male brackets 64 are each generally U-shaped. The male brackets 64 have a first leg 66 and a second leg 67. Each of the first legs 66 is fixedly coupled to the housing 12 such that the second leg 67 extends toward a floor area. Each of the female brackets 65 is a base 68 having a protrusion 69 thereon. The protrusion 69 has a well 70 therein adapted for receiving the second leg 67. The bases 68 of the female brackets are fixedly mounted to a wall 63 and spaced such that each of the female brackets 65 may be in communication with one of the male brackets 64.

In use, the housing acts as a storage closet for fishing accessories. The fishing reels 78 may be placed in the fishing reel mountings 24. The fifth panel 33 may be used as a work station. The securing means 40 holds a plurality of fishing pools 77 and the end of the handle portion of the fishing pool 77 may be placed in the cup 61. The elongate member 57 may be moved up and down with respect to the bottom bracket 42 in order to lower or raise the cup 61.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A storage closet and rack apparatus for removably mounting and storing fishing poles, fishing reels and fishing tackle, said apparatus comprising:

a housing, said housing having a back wall, a first side wall, a second side wall, a bottom wall, a top wall and a front side, said front side comprising a plurality of panels, said plurality of panels comprising drawers, doors and a desk, said housing having a plurality of compartments therein, a portion of said compartments having fishing reel mountings therein, each of said fishing reel mountings being coupled to a wall of said compartments, each of said fishing reel mountings being adapted for holding one of the fishing reels;

a pair of securing means for releasably securing fishing poles to said housing, each of said securing means being fixedly coupled to one of said first and second side walls of said housing.

2. The storage closet and rack apparatus as in claim 1, wherein said plurality of panels comprise:

a first set of panels comprising a pair of doors, said first set of panels being generally adjacent to said top wall, said first set of panels being hingedly coupled to said first and second side walls, a shelf beings mounted in said housing, said shelf being generally adjacent to each the bottom edges of said first set of panels.

3. The storage closet and rack apparatus as in claim 2, wherein said plurality panels comprise:

a second set of panels comprising drawers, said second set of panels being generally adjacent to said first set of panels, said second set of panels being slidably mounted in said housing, said second of panels being positioned generally in a two by one matrix; and a third set of panels comprising drawers, said third set of panels being, located generally adjacent to said second set of panels, said third set of panels being slidably mounted in said housing, said third set of panels being positioned generally in a two by two matrix.

4. The storage closet and rack apparatus as in claim 3, wherein said plurality of panels comprise:

a fourth set of panels, said fourth set of panels being generally adjacent to said third set of panels, said fourth set of panels comprising removably mountable doors, each of said panels of said fourth set of panels being removably mountable to one of said compartments in said housing such that there are four compartments, each of said compartments having said fishing reel mountings therein.

5. The storage closet and rack apparatus as in claim 4, wherein said plurality of panels comprise:

a fifth panel, said fifth panel being generally adjacent to said fourth set of panels, said fifth panel having a bottom edge being hingedly coupled to said first and second side walls by a pair of hinges, each of said hinges having a stop therein such that said fifth panel is biased from moving below a horizontal position, said fifth panel defining a desk, a shelf being mounted in said housing, said shelf being generally adjacent to said bottom edge of said fifth panel, said shelf having a plurality of compartments thereon.

6. The storage closet and rack apparatus as in claim 5, said housing further comprising:

a plurality of slots extending into said front side of said housing, each of said slots being generally located between said fifth panel and said bottom wall of said housing.

7. The storage closet and rack apparatus as in claim 1, wherein each of said fishing reel mountings comprise:

a base portion, said base portion being elongate, said base portion having a distal portion and a proximal portion;

a first sleeve, said first sleeve being integrally mounted to said distal portion of said base portion, said first sleeve being generally hollow and having an opening directed toward said proximal portion of said base portion;

a second sleeve, said second sleeve being slidably mounted in said proximal portion, said second sleeve being generally hollow and having an opening directed toward said distal portion; and a biasing means for biasing said second sleeve toward said first sleeve.

8. The storage closet and rack apparatus as in claim 1, wherein each of said securing means for releasably securing said fishing poles to said housing comprises:

a top bracket, said top bracket being elongate, said top bracket having a back side, front side, top side and bottom side, said back side being fixedly coupled to said housing, said top bracket being located generally adjacent to said top wall of said housing, said top side having a plurality of bores therein, said bores extending through said top bracket, said front side having a plurality of breaks therein for receiving and end of the fishing pole;

a bottom bracket, said bottom bracket being elongate, said bottom bracket having a back side, a front side, a top side and a bottom side, said back side being fixedly coupled to said housing, said bottom bracket being located generally adjacent to said bottom wall of said housing, said top side having a plurality of bores therein, said front side having a plurality of screws therein, each of said screws extending into said bores in said bottom bracket; and a plurality of holders, each of said holders comprising an elongate member having a first and a second end, each of said holders being slidably mountable in said bores in said bottom bracket, a plurality of cups hold a bottom portion of a fishing rod, each of said cups being fixedly coupled to one of said second ends of said elongate members.

9. The storage closet and rack apparatus as in claim 1, further comprising:

at least one fastening means for removably fastening said housing to a wall, each of said fastening means comprising a male bracket and a female bracket, said male brackets being spaced and fixedly coupled to said back wall of said housing, said female bracket being fixedly coupled to wall.

10. The storage closet and rack apparatus as in claim 9, wherein said fastening means comprises:

said male brackets each being generally U-shaped, each of said male brackets having a first leg and a second leg, each of said first legs being fixedly coupled such that said second leg extends toward a floor area, each of said female brackets being a base having a protrusion thereon, said protrusion having a well therein adapted for receiving said second leg, said base of said female brackets being fixedly mounted to a wall and spaced such that each of said female brackets may be in communication with one of said male brackets.

11. A storage closet and rack apparatus for removably mounting and storing fishing poles, fishing reels and fishing tackle, said apparatus comprising:

a housing, said housing having a back wall, a first side wall, a second side wall, a bottom wall, a top wall and a front side, said front side comprising a plurality of panels, said plurality of panels comprising drawers, doors and a desk, said plurality of panels including;

a first set of panels comprising a pair of doors, said first set of panels being generally adjacent to said top wall, said first set of panels being hingedly coupled to said first and second side walls, a shelf being mounted in said housing, said shelf being generally adjacent to each the bottom edges of said first set of panels;

a second set of panels comprising drawers, said second set of panels being generally adjacent to said first set of panels, said second set of panels being slidably mounted in said housing, said second of panels being positioned generally in a two by one matrix;

a third set of panels comprising drawers, said third set of panels being located generally adjacent to said second set of panels, said third set of panels being slidably mounted in said housing, said third set of panels being positioned generally in a two by two matrix;

a fourth set of panels, said fourth set of panels being generally adjacent to said third set of panels, said fourth set of panels comprising removably mountable doors, each of said panels of said fourth set of panels being removably mountable to a compartment in said housing such that there are four compartments, each of said compartments having fishing reel mountings therein, each of said fishing reel mounting being fixedly coupled to a wall in said compartments, each of said fishing reel mounting comprising:

a base portion, said base portion being elongate, said base portion having a distal portion and a proximal portion;

a first sleeve, said first sleeve being integrally mounted to said distal portion of said base portion, said first sleeve being generally hollow and having an opening directed toward said proximal portion of said base portion;

a second sleeve, said second sleeve being slidably mounted in said proximal portion, said second sleeve being generally hollow and having an opening directed toward said distal portion;

a biasing means for biasing said second sleeve toward said first sleeve, said biasing means being mounted in said proximal portion of said base portion, said biasing means being a spring;

a fifth panel, said fifth panel being generally adjacent to said forth set of panels, said fifth panel having a bottom edge being hingedly coupled to said first and second side walls by a pair of hinges, each of said hinges having a stop therein such that said fifth panel is biased from moving below a horizontal position, said fifth panel defining a desk, a shelf being mounted in said housing, said shelf being generally adjacent to said bottom edge of said fifth panel, said shelf having a plurality of compartments thereon;

a plurality of slots extending into said front side of said housing, each of said slots being generally located between said fifth panel and said bottom wall of said housing said slots defining cubby holes in said housing;

a pair of securing means for releasably securing fishing poles to said housing, each of said securing means being fixedly coupled to one of said first and second side walls of said housing, each of said securing means comprising:

a top bracket, said top bracket being elongate, said top bracket having a back side, front side, top side and bottom side, said back side being fixedly coupled to said housing, said top bracket being located generally adjacent to said top wall of said housing, said top side having a plurality of bores therein, said bores extending through said top bracket, said front side having a plurality of breaks therein, each of said breaks being generally adjacent to one of said bores, said breaks extending into said bores, each of said breaks having two sides, each of said sides having a nub thereon, each of said nubs comprising an elastomeric material;

a bottom bracket, said bottom bracket being elongate, said bottom bracket having a back side, a front side, a top side and a bottom side, said back side being fixedly coupled to said housing, said bottom bracket being located generally adjacent to said fifth panel, said top side having a plurality of bores therein, said front side having a plurality of screws therein, each of said screws extending into said bores in said bottom bracket;

a plurality of holders, each of said holders comprising an elongate member having a first and a second end, each of said holders being slidably mountable in said bores in said bottom bracket, each of said first ends having an annular flange thereon, each of said flanges having a width larger than a width of said bores in said bottom bracket, a plurality of cups hold a bottom portion of a fishing rod, each of said cups being fixedly coupled to one of said second ends of said elongate members; and a pair of fastening means for removably fastening said housing to a wall, each of said fastening means comprising a male bracket and a female bracket, said male brackets being spaced and fixedly coupled to said back wall of said housing, said male brackets each being generally U-shaped, each of said male brackets having a first leg and a second leg, each of said first legs being fixedly coupled such that said second leg extends toward a floor area, each of said female brackets being a base having a protrusion thereon, said protrusion having a well therein adapted for receiving said second leg, said base of said female brackets being fixedly mounted to a wall and spaced such that each of said female brackets may be in communication with one of said male brackets.

* * * * *